US009180350B2

(12) United States Patent
Pringle et al.

(10) Patent No.: US 9,180,350 B2
(45) Date of Patent: Nov. 10, 2015

(54) PACE OF PLAY MONITORING SYSTEM

(71) Applicants: Matthew M. Pringle, Bordentown, NJ (US); Ross T. Galarneault, Whitehouse Station, NJ (US)

(72) Inventors: Matthew M. Pringle, Bordentown, NJ (US); Ross T. Galarneault, Whitehouse Station, NJ (US)

(73) Assignee: UNITED STATES GOLF ASSOCIATION, Far Hills, NJ (US)

( * ) Notice: Subject to any disclaimer, the term of this patent is extended or adjusted under 35 U.S.C. 154(b) by 91 days.

(21) Appl. No.: 14/180,966

(22) Filed: Feb. 14, 2014

(65) Prior Publication Data

US 2015/0231460 A1 Aug. 20, 2015

(51) Int. Cl.
*G08B 13/14* (2006.01)
*A63B 57/00* (2015.01)

(52) U.S. Cl.
CPC ..... *A63B 57/00* (2013.01); *G08B 13/14* (2013.01); *A63B 2243/0029* (2013.01)

(58) Field of Classification Search
CPC ..... A63B 57/00; A63B 2225/20; A63B 2243/0029; A63B 57/0056; A63B 71/0686
USPC ..... 340/568.6, 686.1, 687, 686.4, 686.6, 340/691.6; 473/199, 409, 131, 180
See application file for complete search history.

(56) References Cited

U.S. PATENT DOCUMENTS

| | | | | |
|---|---|---|---|---|
| 4,303,243 | A | 12/1981 | Wolfe | |
| 5,086,390 | A | 2/1992 | Matthews | |
| 5,097,416 | A | 3/1992 | Matthews | |
| 5,386,990 | A | 2/1995 | Smith | |
| 6,030,109 | A | 2/2000 | Lobsenz | |
| 6,062,985 | A * | 5/2000 | Rege | 473/199 |
| 6,346,055 | B1 * | 2/2002 | Rege | 473/409 |
| 8,068,386 | B2 * | 11/2011 | Mosher | 368/10 |
| 2004/0064206 | A1 * | 4/2004 | Kim | 700/91 |
| 2004/0203410 | A1 * | 10/2004 | Kim | 455/66.1 |
| 2004/0243262 | A1 | 12/2004 | Hofmann | |

* cited by examiner

*Primary Examiner* — Toan N Pham
(74) *Attorney, Agent, or Firm* — Francis C. Hand; Carella, Byrne, et al

(57) ABSTRACT

The monitoring system employs a sensor to detect the replacement or removal and replacement of the flagstick in a golf hole liner. The sensor may be incorporated into the flagstick, the hole liner or any combination of the two. A central receiver remote from the sensors receives the two signals from respective sensor and has a timing device for recording the time of arrival of each signal from each sensor.

14 Claims, 4 Drawing Sheets

PACE OF PLAY MONITORING SYSTEM

This invention relates to a pace of play monitoring system. More particularly, this invention relates to a pace of play monitoring system for the game of golf.

BACKGROUND OF THE INVENTION

The pace of play on a golf course is critical to the successful operation of both golf facilities and tournament golf. In order to successfully manage pace on a golf course, it is vital that the overall pace of lead groups and the intervals between successive groups (i.e., the cycle time) be carefully monitored and controlled.

In its most basic form, the time to play of a group (group i in this case) is given by the following equation:

$$T_{round}^{i}=T_{round}^{i-1}+\Delta T_{cycle}^{i}-\Delta T_{start}^{i}$$

where $\Delta T_{cycle}^{i}$ is the cycle time for group i and $\Delta T_{start}^{i}$ is the starting time interval. In other words, the time it takes for group i to play is equal to the time it takes for the preceding group to play plus the cycle time, minus the starting time interval. This can be made even more general by considering all of the groups that proceed group i:

$$T_{round}^{i} = T_{round}^{1} + \sum_{k=2}^{i} \Delta T_{cycle}^{k} - \sum_{k=2}^{i} \Delta T_{start}^{k}$$

As can be seen in the above equations, in order to successfully manage pace of play, three key elements must be measured and controlled:

the pace of group 1 the cycle time between successive groups the starting interval

Currently, the best opportunity to monitor these key timing metrics is through the use of a golf-cart based GPS tracking system. These systems incorporate a GPS tracking and mapping system on individual golf carts. Zones around the golf course are created such that, as the cart moves through the golf course, the time when the golfer starts and completes each hole, for example, can be measured. The position of the cart and these times may then be relayed to a central receiver where the golf course operator can monitor the progress of each cart. Management decisions based on this timing data can be made accordingly.

There are a number of drawbacks with such cart based systems. A golf course may typically have 75, 100 or more golf carts and so the cost of employing the GPS tracking can be prohibitively expensive. Also, not all golfers elect to ride carts.

Another system that could be envisioned employs radio frequency identification (RFID) tags carried by the golfer and a system of RFID readers placed throughout the golf course, similar to timing systems used for running and other multi-sport races. Such a system also has significant drawbacks in that the golfers would be required to carry and return the RFID tags. Golfers would also have to be channeled such that they came within the required close proximity of the RFID readers.

Accordingly, it is an object of the invention to provide a simplified and reliable system for monitoring the pace of play of a golf game.

It is another object of the invention incorporate monitoring the pace of play of a golf game into the actual play of a group of players.

BRIEF DESCRIPTION OF THE INVENTION

Briefly, the invention takes advantage of the fact that virtually every golf hole utilizes a flagstick or similar in the hole and that, most of the time, the flagstick is removed during play of the hole by a group and then replaced upon completion of the hole.

In accordance with the invention, the monitoring system employs a sensor to detect the replacement of the flagstick in the hole or a sensor to detect the removal of a flagstick from a hole and a subsequent replacement of the flagstick in the hole.

The sensor may be incorporated into the flagstick, the hole or any combination of the two. For example, the sensor may be one of a:

- Magnetic sensor in the flag or hole and a corresponding magnet in the hole or flag
- Optical sensor for detecting replacement of a ferrule of a flagstick into a socket in the hole or for detecting removal and replacement of the flagstick ferrule.
- Capacitance proximity sensor in either the flagstick or the hole
- Mechanical switch activated by the replacement or removal and replacement of the flagstick
- Proximity sensor, such as, an ultrasonic or laser proximity sensor
- Any sensor configuration that may be primarily housed in the flagstick or hole interchangeably.

The monitoring system also employs a central microprocessor for recording the time of the event sensed by the sensor.

The microprocessor may be powered by a wired connection to a mains power or a low voltage source. The microprocessor is most preferably powered by a battery housed in either the flagstick or the hole. The battery may be replaceable or may be rechargeable. A rechargeable battery may be charged either through a direct wired connection or by an inductive means. Additionally, in order to prolong battery life, the system may incorporate a small solar cell, most preferably located at the top of the flagstick. The microprocessor may include one or more low power modes in order to prolong battery life.

The microprocessor may or may not include algorithms to determine if the flagstick removal or replacement event is likely to be the final event for a particular group. As an example, if the flagstick is removed and replaced multiple times within a short period of time, the microprocessor algorithm may reject all but the final replacement as an indicator that the hole has been completed by a particular group.

The microprocessor includes systems permitting one or two way communication with a central receiver of the monitoring system.

The timing of the event sensed by the sensor is communicated to the central receiver via any means. These means are preferably a wired or wireless electronic or optical communication, and most preferably by means of a wireless communication. The communication may be directly or indirectly sent to the central receiver.

In the case of a wireless transmission, the flagstick may be equipped with an internal or external antenna to improve the data transmission reception. Event timing communication may be sent immediately following the event or may be sent at regular or irregular intervals. Communication may include either single events or multiple events that may be communicated in a single packet in order to reduce power consumption.

Further features to reduce power consumption and prolong battery life may be incorporated into the system. These features could include, for example a low power mode at night time activated by either a clock internal to the microprocessor or a signal from the central receiver.

In addition to the removal/replacement event timing, the transmitted data may also include other useful information such as:

- location of the sensor as determined by a GPS receiver
- identification number of the system
- identification of the course
- identification of hole number (i.e., 1 through 18)
- status information of system (battery level, faulty sensor, and the like)

In addition, the identification number and hole location of a particular sensor may be programmed by a user either wirelessly or through a wired data connection. Upon receiving the data, the central receiver may process and interpret the data. The timing data may be displayed directly to a user.

The central receiver may be the final destination of the data or, preferably, the central receiver will be connected to the internet or another data network via either a wired or wireless connection. The data will then be sent, over the internet or data network to additional receivers for processing.

The position of each group on the golf course is inferred through the timing data at the central receiver or to additional receivers. Since the position of individual groups is not tracked explicitly, the system may incorporate methods and algorithms for improving group tracking. These may include, but are not limited to:

- confirmation and/or correction of group position by golf course personnel using either the central receiver or via software applications on or through a smart phone, tablet, computer and the like.
- heuristic or probabilistic algorithms
- software applications on individual golfer's smart phones The data is processed and several important timing metrics are reported at the central receiver and/or additional receivers. The metrics include, but are not limited to:

- pace and position of individual groups
- intervals between groups at individual holes (i.e., cycle time)

Data reports may be in tabular or graphical formats and may or may not include maps of the golf course. In addition to the data, the system may be programmed to provide alerts to golf course personnel and/or individual golfers. These alerts may include, but are not limited to:

- groups who are beyond a stipulated pace
- gaps between groups that exceed stipulated limits The reporting of alerts may be in the form of:

- messages on the central receiver and/or additional receivers
- messages relayed to golf course personal on their cell phones or wireless radios. Such messages may be text (SMS messaging, app alerts, and the like) or audio
- messages relayed to individual golfers on their cell phones. Such messages may be text (SMS messaging, app alerts, and the like) or audio Golf course personnel may then take actions to improve pace of play when alerted by, for example:

- requesting golfers to speed up their play
- requesting or compelling golfers to use forward tees
- requesting or compelling golfers to skip a hole or multiple holes to return to their proper position
- metering the flow of golfers onto the golf course to prevent later backups.

These and other objects of the invention will become more apparent from the following detailed description taken in conjunction with the accompanying drawings wherein.

Figure 3:
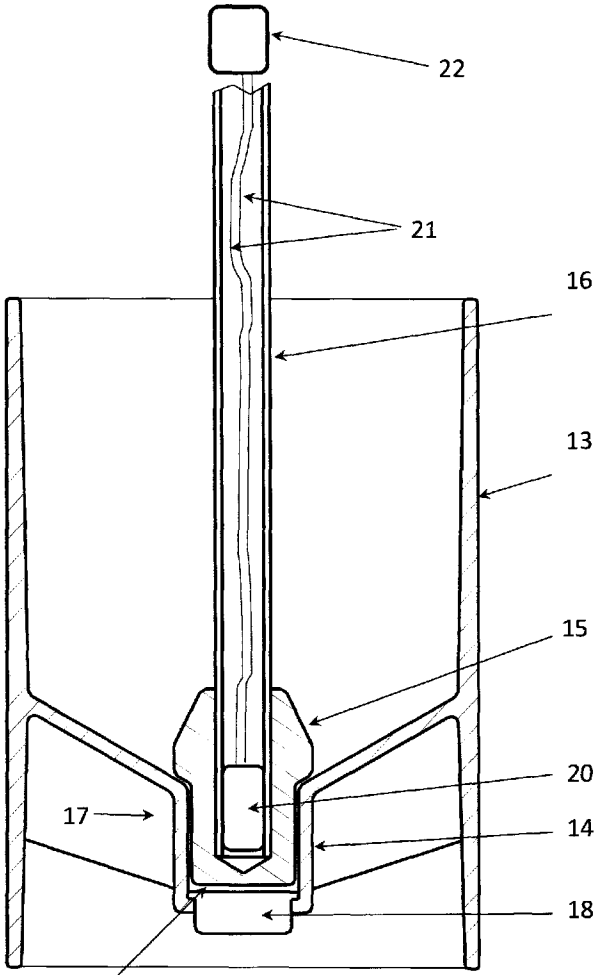
Figure 4:
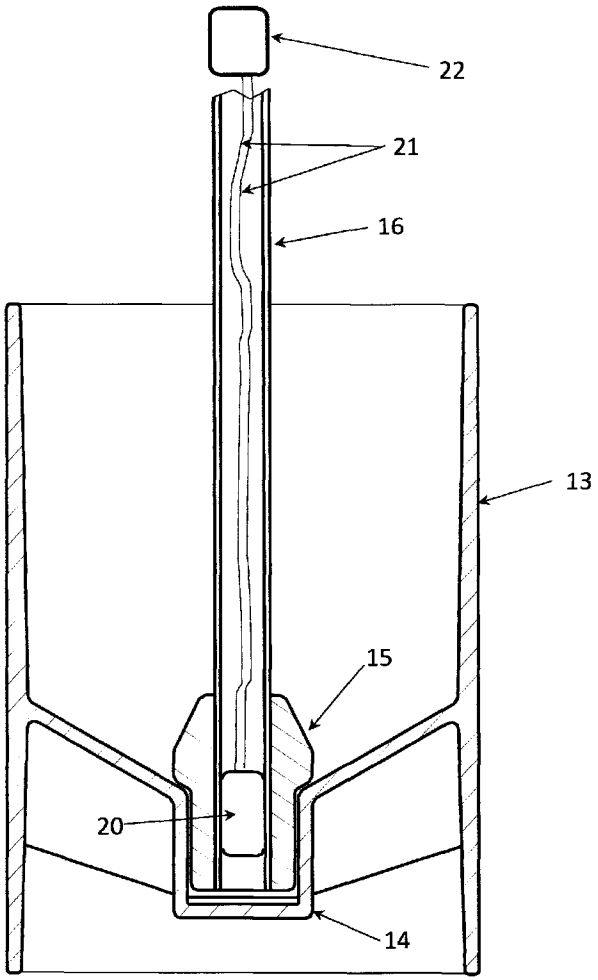

FIG. 3 illustrates a schematic cross-sectional view of a flagstick provided with a magnetic sensor for communicating with a receiver of a monitoring system constructed in accordance with the invention; and FIG. 4 illustrates a schematic cross-sectional view of a flagstick provided with a light or proximity sensor for communicating with a receiver of a monitoring system constructed in accordance with the invention.

Figure 1:
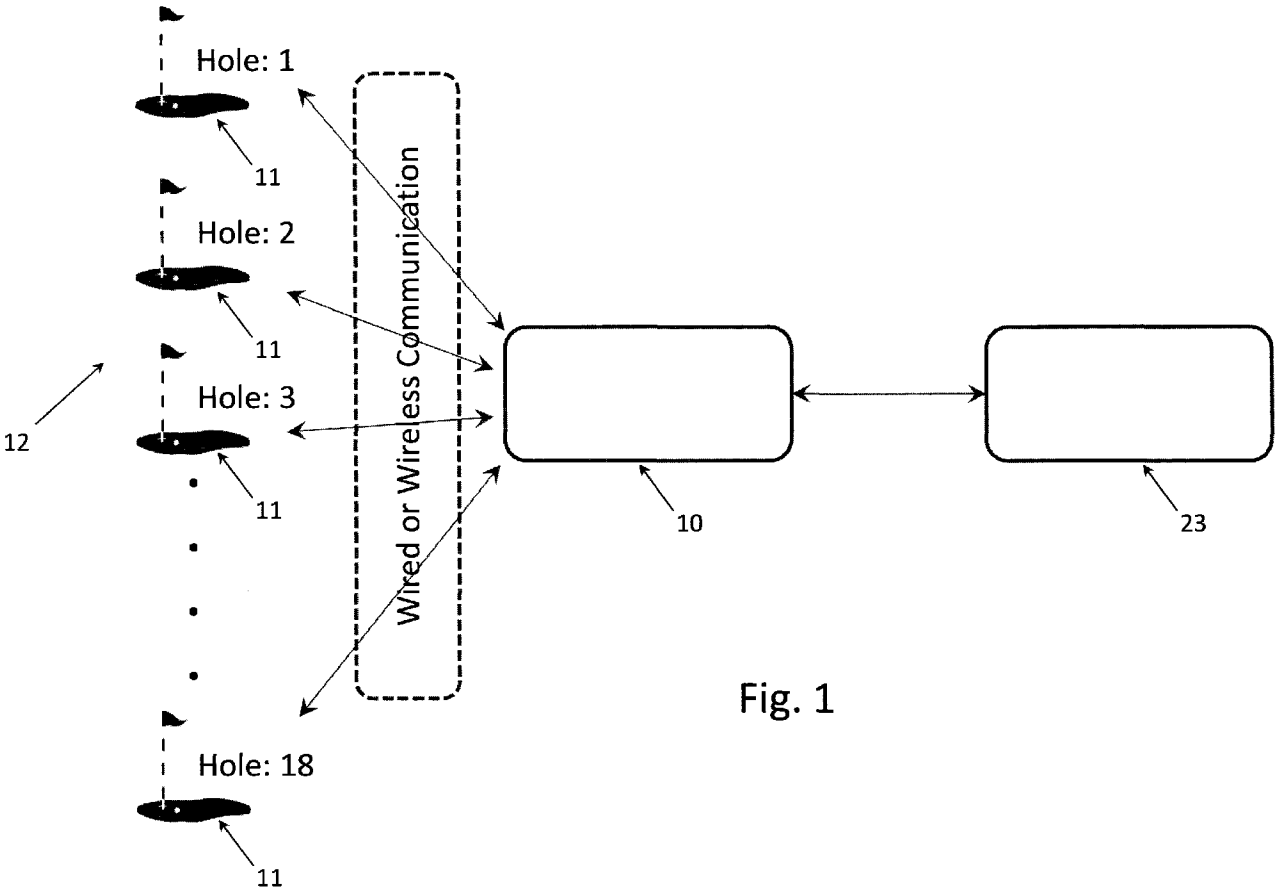
FIG. 1 illustrates a schematic view of one form of data communication employed by the monitoring system of the invention.

Referring to FIG. 1, the monitoring system for a golf course includes a central receiver 10 for receiving information in the form of one or more signals from each hole 11 of a plurality of holes of a golf course 12. For example, the golf course may be an 18 hole course or a 9 hole course and the central receiver may receive information from each hole of the selected course or from only selected holes of the course.

The central receiver 10 may receive the information from the respective holes 11 by wired communication or wireless communication.

Referring to FIG. 3, each hole 11 is constructed in a conventional manner with a standard hole liner 13 and a standard hole socket 14 in order to slidably receive a vertically disposed standard flagstick ferrule 15 of a flagstick 16.

In accordance with the invention, the pace of play monitoring system for a golf course comprises a plurality of sensors 17, each of which is disposed at a respective hole of the golf course for sensing removal of a flagstick 16 from a respective liner 13 and emitting a first signal in response thereto and for sensing a subsequent return of the flagstick 16 into the liner 13 and emitting a second signal in response thereto.

The central receiver 10 is remote from the plurality of sensors 17 for receiving the first signal and second signal from each respective sensor 17. The receiver 10 has a timing device for recording the time of arrival of each of the two signals from each said sensor 17.

As illustrated, each sensor 17 includes a permanent magnet 18 disposed in the base of the hole socket 14. As illustrated, the magnet 18 is of circular shape to fit into a circular opening in the base of the hole socket 14 and has an annular lip 19 for seating on the socket 14. Alternatively, the magnet 18 may be of any other suitable shape and size to be mounted in the base of the hole socket 14.

Also, in accordance with the invention, the flagstick 16 is hollow and carries a magnetic sensor 20 within the plane of the ferrule 15 in a position to cooperate with the magnet 18. In addition, the sensor 20 communicates via wires 21 with a microprocessor 22 within the flagstick 16.

Of note, the magnet 18 and sensor 20 may be placed in the flagstick 16 and hole socket 14 interchangeably.

In operation, in response to removal of the flagstick ferrule 15 from the hole socket 14 and, thus, the sensor 20 from the vicinity of the magnet 18, the sensor 20 would send a signal to the microprocessor 22 for processing and communication with the central receiver 10 (FIG. 1).

The microprocessor 21 may be programmed to detect the removal of the flagstick ferrule 15, the replacement of the flagstick ferrule 15 or both removal and replacement. Data reduction algorithms in the microprocessor would preferably be such that only the time of the replacement is transmitted to the central receiver 10. However, the removal time may be used to determine spurious events, and the like.

Referring to FIG. 4, wherein like reference characters indicate like parts as above, an alternative means of sensing removal and replacement may use a light or proximity sensor (ultrasonic and the like) 20' to detect the proximity of the hole socket 14 or (preferably) flagstick ferrule 15 interchangeably to detect the removal and/or replacement of the flagstick 16.

Other means of sensing removal and/or replacement of the flagstick ferrule 15 may include a light sensor (not shown), such as a photodiode or similar, incorporated into the hole socket 14 or (preferably) the flagstick ferrule 15 to detect the presence of light and therefore the removal and/or replacement of the flagstick 16.

In operation, the microprocessor 22 receives the removal and/or replacement signals from the sensor 20, 20'. The signal may be a change in voltage or current level using an analog to digital converter and may also be a simple digital voltage level state change. The microprocessor 22 preferably incorporates data reduction algorithms to limit the transmission of data to the central receiver 10. This preferably includes a minimum time between replacement signals. For example, if two removal/replacement events are detected within a specified length of time, preferably 10 minutes, or more preferably within 5 minutes and most preferably within 3 minutes, the algorithm will send only the last replacement with the presumption that the first removal/replacement was by the same group. The time of removal and/or replacement(s) is recorded by the microprocessor 22 using an internal clock. The microprocessor then transmits the time of the event(s) as well as an identification number of the particular flagstick/hole combination to the central receiver 10.

The data is transmitted by either a wired or preferably a wireless communication. For example, the flagstick/hole system may include a radio frequency transmission unit, such as a VHF or UHF modem. Most preferably, the system includes a suitably powerful WiFi transmitter/receiver unit.

The microprocessor 22 is able to determine the time elapsed between the time of arrival of the first signal and the second signal from each sensor 20, 20' as an indication of the time elapsed for play of the green of each respective hole.

Likewise, the central receiver 10 is able to determine the lapse of time between successively received signals from a predetermined hole as an indication of the time of play between successive groups of golfers.

Figure 2:
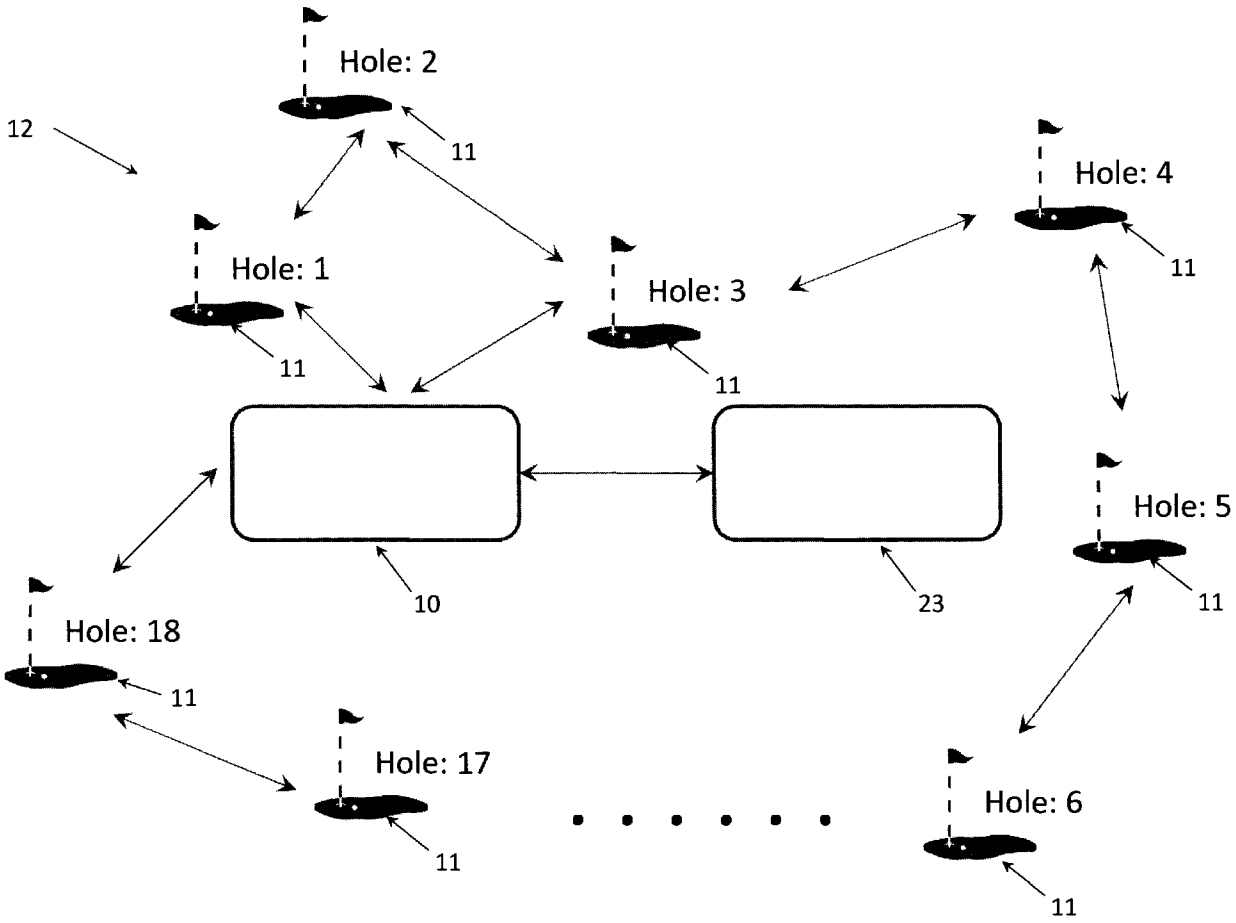
FIG. 2 illustrates a schematic view of a second form of data communication employed by a monitoring system of the invention.

Alternatively, as illustrated in FIG. 2, wherein like reference characters indicate like parts as above, the data collected at each flagstick/hole unit may be sent directly to the central receiver 10 or, preferably, may also be relayed via other flagstick/hole units acting as nodes in a wireless mesh network.

(see http://en.wikipedia.org/wiki/Wireless_mesh_network)

In addition to the removal and/or replacement event timing and flagstick/hole system identification, the system may also transmit:

- location of the sensor as determined by a GPS receiver
- identification of hole number (i.e., 1 through 18)
- status information of system (battery level, faulty sensor, and the like)

In accordance with the invention, the pace of play on a golf course is easily established by monitoring the progression of the flagstick removal and/or replacement events for the first group of the day at each hole. Successive events will be interpreted as indicative of the cycle time between successive groups. As described above, algorithms in the microprocessor (or interchangeably in the central receiver) will substantially eliminate spurious and false events such that the timing data will accurately measure the cycle time between successive groups.

Typically, golf courses utilize a starting time scheduling software application. This information may be transmitted to the central receiver. Alternatively, a dedicated system, similar in most respects to the flagstick/hole system may be dedicated to signaling the starting time of groups. The starting time event may be signaled by, for example, but not limited to:

- the golf course starter depressing a button
- a proximity sensor located near the first tee The pace of the first group is controlled by communicating to the golf course operator via a computer application located either on the central receiver or additional receiver(s) 23 (see FIG. 1) the progression of the first group around the course and the progression relative to an established norm. If the first group is behind the established norm, the golf course operator would then take measures to reestablish their position and pace. These could include, but are not limited to:

- requesting golfers to speed up their play
- requesting or compelling golfers to use forward tees
- requesting or compelling golfers to skip a hole or multiple holes to return to their proper position Similarly, the cycle time between successive groups would be monitored relative to an established norm. Again, if a group is determined to be behind the established norm, the golf course operator may take measures to reestablish their position and pace which may include, but are not limited to:

- requesting golfers to speed up their play
- requesting or compelling golfers to use forward tees
- requesting or compelling golfers to skip a hole or multiple holes to return to their proper position Additionally, individual holes may be analyzed for chronically excessive cycle times. The golf course operator may then take measures to reduce such excessive cycle times which may include, but are not limited to:

- shortening the hole
- locating the hole in easier locations on the green
- reducing size and/or difficulty of hazards Referring to FIG. 2, additional receivers 23 may be connected via an optional internet connection to the central receiver 10 so that the information obtained by the central receiver 10 may be relayed to the additional receivers 23, for example, via an internet connection. Such additional receivers 23 may be located at remote locations. For example, an additional receiver 23 may be employed by a marshal to monitor the play of a designated group of golfers. An additional receiver may be located at a remote location to monitor the play at a plurality of golf courses.

The invention thus provides a simplified and reliable system for monitoring the pace of play of a golf game. In particular, the invention incorporates monitoring the pace of play of a golf game into the actual play of a group of players.

What is claimed is:

1. A pace of play monitoring system for a golf course comprising a plurality of sensors, each said sensor being disposed at a respective hole of the golf course for sensing removal of a flagstick from the respective hole and emitting a first signal in response thereto and for sensing a subsequent return of the flagstick into the hole and emitting a second signal in response thereto; and a receiver remote from said plurality of sensors for receiving said first signal and said second signal from each respective sensor, said receiver having a timing device for recording a time of arrival of each said first signal and said second signal from each said sensor.

2. A pace of play monitoring system as set forth in claim 1 further comprising a microprocessor in said flagstick for determining a time elapsed between the time of arrival of said first signal and said second signal from a respective sensor as an indication of the time elapsed for play of each respective hole.

3. A pace of play monitoring system as set forth in claim 1 wherein said receiver determines a lapse of time between successively received signals from a predetermined hole as an indication of a time of play between successive groups of golfers.

4. A pace of play monitoring system as set forth in claim 1 wherein at least one of said plurality of sensors is disposed on one of a golf hole liner and a flagstick vertically disposed in a respective hole.

5. A pace of play monitoring system as set forth in claim 4 wherein said one sensor includes a permanent magnet disposed in said liner; a magnetic sensor disposed on said flagstick for sensing at least one of movement of said flagstick from said liner and said flagstick into said liner; and a microprocessor in said flagstick electronically connected to said sensor for emitting a signal therefrom indicative of one of movement of said flagstick from said liner and said flagstick into said liner.

6. A pace of play monitoring system as set forth in claim 4 wherein said one sensor includes a proximity sensor disposed on one of said liner and said flagstick for sensing at least one of movement of said flagstick from said liner and said flagstick into said liner; and a microprocessor in said flagstick electronically connected to said sensor for emitting a signal therefrom indicative of one of movement of said flagstick from said liner and said flagstick into said liner.

7. A pace of play monitoring system for a golf course comprising a plurality of sensors, each said sensor being disposed at a respective hole of the golf course for sensing replacement of a flagstick from the respective hole and emitting a first signal in response thereto; and a receiver remote from said plurality of sensors for receiving said first signal from each respective sensor, said receiver having a timing device for recording a time of arrival of each said first signal from each said sensor.

8. In combination, a golf hole liner having a socket therein;

a vertically disposed flagstick having a ferrule slidably mounted in said socket;

a sensor for detecting at removal of said flagstick from said socket and emitting a first signal in response thereto and insertion of said flagstick into said socket and emitting a second signal in response thereto; and a receiver remote from said sensor for receiving said first signal and said second signal from said sensor, said receiver having a timing device for recording a time of arrival of each said first signal and said second signal from said sensor .

9. The combination as set forth in claim 8 wherein said sensor includes a permanent magnet disposed on one of said socket and said flagstick; a magnetic sensor disposed on an other of said socket and said flagstick for sensing at least one of movement of said flagstick from said socket and said flagstick into said socket; and a microprocessor in said flagstick electronically connected to said sensor for emitting a signal therefrom indicative of one of movement of said flagstick from said socket and said flagstick into said socket.

10. The combination as set forth in claim 9 wherein said flagstick is hollow and houses a plurality of wires electronically connecting said sensor to said microprocessor.

11. The combination as set forth in claim 8 wherein said sensor includes a proximity sensor disposed on one of said socket and said flagstick for sensing at least one of movement of said flagstick from said socket and said flagstick into said socket; and a microprocessor in said flagstick electronically connected to said sensor for emitting a signal therefrom indicative of one of movement of said flagstick from said socket and said flagstick into said socket.

12. The combination as set forth in claim 11 wherein said flagstick is hollow and houses a plurality of wires electronically connecting said sensor to said microprocessor.

13. The combination as set forth in claim 8 wherein said sensor is disposed in said flagstick.

14. The combination as set forth in claim 13 wherein said sensor includes a permanent magnet disposed in a base of said socket; a magnetic sensor disposed on said flagstick for sensing at least one of movement of said flagstick from said socket and said flagstick into said socket; and a microprocessor in said flagstick electronically connected to said sensor for emitting a signal therefrom indicative of one of movement of said flagstick from said socket and said flagstick into said socket.

* * * * *

UNITED STATES PATENT AND TRADEMARK OFFICE

CERTIFICATE OF CORRECTION

PATENT NO. : 9,180,350 B2
APPLICATION NO. : 14/180966
DATED : November 10, 2015
INVENTOR(S) : Pringle et al.

It is certified that error appears in the above-identified patent and that said Letters Patent is hereby corrected as shown below:

Claims

Column 8
Line 1, claim 8, delete "at"

Signed and Sealed this
Twenty-third Day of February, 2016

Michelle K. Lee

Michelle K. Lee
*Director of the United States Patent and Trademark Office*